United States Patent [19]

Bennett

[11] 3,935,961

[45] Feb. 3, 1976

[54] UNITARY BEVERAGE CONTAINER

[76] Inventor: Robert A. Bennett, 170 Sturbridge Road, Easton, Conn. 06484

[22] Filed: Sept. 30, 1974

[21] Appl. No.: 510,152

[52] U.S. Cl. ..... 220/266; 220/276

[51] Int. Cl.[2] ..... B65D 41/32

[58] Field of Search ..... 220/265, 266, 260, 268, 220/276

[56] References Cited

UNITED STATES PATENTS

| | | | |
|---|---|---|---|
| 3,246,791 | 4/1966 | Asbury | 220/268 |
| 3,262,611 | 7/1966 | Palmer | 220/268 |
| 3,307,746 | 3/1967 | Edwards | 220/265 |
| 3,334,775 | 8/1967 | Klein | 220/268 |
| 3,759,206 | 9/1973 | Dalli | 220/281 |
| 3,779,417 | 12/1973 | Klein | 220/269 |
| 3,794,206 | 2/1974 | DeLine | 220/281 |
| 3,843,011 | 10/1974 | Perry | 220/260 |

*Primary Examiner*—William Price
*Assistant Examiner*—Ro E. Hart
*Attorney, Agent, or Firm*—Mattern, Ware and Davis

[57] ABSTRACT

A unitary beverage container lid allows easy opening and drinking therefrom without the generation of removable parts. The lid, which may be integrally formed with the cylindrical sidewall of the container, incorporates a generally dome-shaped central portion incorporating a pair of radially projecting abutting ribs. The line defining the adjoining edges of these ribs is scored for easy tearing. The dome-shaped central portion terminates with a downwardly, inwardly projecting peripheral sidewall that is sealed to or integrally formed with the cylindrical sidewall of the container. An upstanding arcuate rib with tapered ends forms a portion of the terminating region between the central portion and the peripheral sidewall and is scored by an arcuate score line.

Initial depression of a centrally located button on the dome-shaped portion of the lid causes the tapered rib to tear from the sidewall of the lid, thereby initiating the separation of the two abutting ribs. Further depression of the button completes this tearing along the score line of the two abutting ribs and the tapered arcuate rib thereby generating a pie-shaped drinking orifice in the lid.

15 Claims, 8 Drawing Figures

UNITARY BEVERAGE CONTAINER

BACKGROUND OF THE INVENTION

The present invention is a new and useful beverage container lid that allows opening and drinking therefrom without the generation of removable parts and without the need for external opening devices. Since the time of widespread acceptance of the pull-tab for opening beverage containers, efforts have been made to solve the undesirable aspect of these pull-tab lids; specifically, in their generation of dangerous and unsightly tabs after opening the lids. These tabs have been found to cause widespread environmental hazards to wild animals as well as posing hazards to people when such items are stepped on by bare feet. However, people in general have been unwilling to accept the use of external tools to open beverage lids, such as the formerly widespread beer can opener and thus the need for a unitary beverage container lid with no removable parts and no need for external tools had remained unanswered. The present invention is the solution to this problem by providing such a lid that is inexpensive and simple to manufacture.

The prior art inventions, since the initial development of the pull-tab beverage container lid, have been directed at beverage container lids to improve upon this pull-tab arrangement. None of these prior art inventions, however, anticipate the present invention, since none of them teach the generation of a drinking orifice along a radially projecting score line in a dome-shaped region of a beverage container lid.

More specifically, U.S. Pat. No. 3,262,611, Palmer, teaches the generation of two openings in a can lid when the sidewall of the can is manually squeezed. By this patent's teachings, the lid is forced into a highly convex configuration in order to generate these openings in the can lid. The present invention, however, generates a unitary drinking orifice by depression of a generally dome-shaped lid into a generally concave configuration thereby causing the spreading apart of the lid along a radially projecting scored region. The present invention, therefore, does not require deformation of the sidewalls of the beverage container as taught by this prior art invention.

U.S. Pat. No. 3,307,746, Edwards, is another patent teaching the opening of a can lid without the generation of a removable part. However, this invention utilizes a generally rectangular indented central portion of a lid that is then raised above the surface of the remainder of the can lid to generate orifices in the can lid. This patent does not teach the present invention since it requires a pulling and not a pushing operation to generate the openings and also because the openings are not generated by the spreading apart of a radially projecting score line in a dome-shaped lid, but are generated by the rupture of wall seams connecting the generally rectangular indented portion of the lid to the remainder of the lid.

Other prior art patents, such as U.S. Pat. Nos. 3,227,324 and 3,246,791, both Asbury, and 3,334,775 and 3,779,417, both Klein, disclose a technique for generating at least one drinking orifice in a can lid by depression of a scored region in the can lid. In all of these patents, the drinking orifice, or orifices, in the can lid are pre-scored in the lid and are not generated by the spreading apart of a radially projecting score line in a dome-shaped lid. Furthermore, all these prior art inventions generate a removable part that must be discarded or pushed into the beverage container. Both of these alternatives are, of course, undersirable from an environmental standpoint. Furthermore, some of these lids are objectionable from a health standpoint since they require drinking a beverage with a portion of a lid immersed therein that was previously exposed to outside contamination.

Thus, the present invention is a new and useful beverage container lid that generates a drinking orifice without the generation of removable parts and without the need for external devices. The use of a dome-shaped lid with a radially projecting score line terminating with an arcuate score line at the region of a sidewall connecting the dome-shaped portion of the lid to the beverage container is not taught or suggested by the prior art patents. In addition, the use of a centrally located button for depression of the dome-shaped lid is not taught or suggested by the prior art patents. Furthermore, the use of a pair of radially projecting ribs along the radially projecting score line, an arcuate rib along the arcuate score line, and a U-shaped rib substantially diametrically opposed to the radially projecting pair of adjoining ribs to strengthen and facilitate the generation of a drinking orifice is not taught or suggested by the prior art patents.

SUMMARY OF THE INVENTION

The unitary beverage container lid of the present invention incorporates a generally dome-shaped central portion terminating with an inwardly and downwardly projecting peripheral sidewall. This peripheral sidewall terminates with one end of a cylindrically shaped beverage container and is either sealed thereto or integrally formed therewith.

The beverage container lids of the present invention also incorporate a pair of substantially radially projecting abutting ribs extending from the central portion of the dome-shaped portion of the lid to near one region of the peripheral sidewall of the lid. The region where the abutting ribs are joined is scored by a radially extending score line so as to provide easy tearing thereof. This score line extends to the peripheral sidewall. The dome-shaped lid also incorporates an arcuate rib adjacent to a portion of the terminating region between the central portion and the peripheral sidewall that perpendicularly joins with the abutting ribs. This arcuate rib is bisected by the radially extending score line. This arcuate rib is scored by an arcuate score line in the region where it joins with the peripheral sidewall.

Manual depression of a central button in the dome-shaped portion of the can lid causes the arcuate score line to rupture and tear. The button facilitates application of manual pressure to the lid's central region while the initial rupture and tearing of the arcuate score line allows for the escape of pressurized gas within the beverage container and also allows the radial score line to start tearing at its outward end. This tearing continues to radially spread inward along this radial score line. The inward projection of the peripheral sidewall also allows the outer ends of the abutting ribs to extend below the region of the peripheral sidewall as the abutting ribs are spreading apart to form a pie-shaped drinking orifice. This allowance of the outer ends of the abutting ribs to spread beneath the sidewall is necessitated by the planar radial extension of the dome-shaped lid as it is depressed from a dome-shaped configuration into a generally concave configuration.

Furthermore, the present invention incorporates a U-shaped rib extending from the central portion of the lid outward to the peripheral sidewall so as to provide structural rigidity to the region being manually depressed.

The combination of the above portions of the present invention forms a beverage container lid that is easily opened by manual depression without the need for external tools and which generates a well defined drinking region. In addition, the generation of the drinking region does not cause the formation of removable parts. Furthermore, the drinking orifice is safe to drink from due to the abutting ribs and the peripheral arcuate tapered rib defining a smooth surface in which to make oral contact.

OBJECTS OF THE INVENTION

Therefore, it is a principal object of the present invention to provide a unitary beverage container lid that is easy to manually open without the need for external tools and which does not generate any removable parts.

It is another object of the present invention to provide a beverage container lid of the above description that may be integrally formed with a cylindrical sidewall of a beverage container.

It is a further object of the present invention to provide a beverage container lid of the above character that generates a drinking orifice that is safe to drink from.

Another object of the present invention is to provide a beverage container lid of the above character that is inexpensive to manufacture.

Other objects of the present invention will in part be obvious and will in part appear hereinafter.

The invention accordingly comprises an article of manufacture possessing the features, properties, and the relation of elements which will be exemplified in the article hereinafter described, and the scope of the invention will be indicated in the claims.

THE DRAWINGS

For a fuller understanding of the nature and objects of the invention, reference should be had to the following detailed description in conjunction with the accompanying drawings, in which.

DETAILED DESCRIPTION

Figure 1:
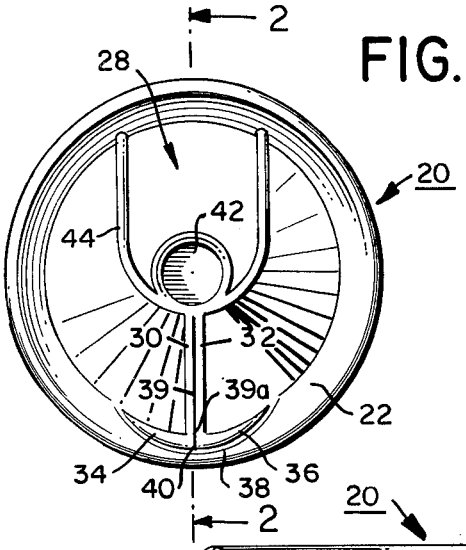
FIG. 1 is a top plan view of a unitary beverage container lid of the present invention in the closed configuration.
Figure 2:
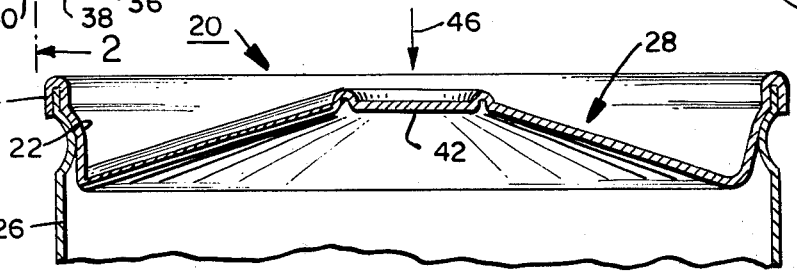
FIG. 2 is a cross-sectional side view of the unitary lid of FIG. 1 taken along line 2—2 of FIG. 1 showing the lid mounted to a beverage container.
Figure 6:
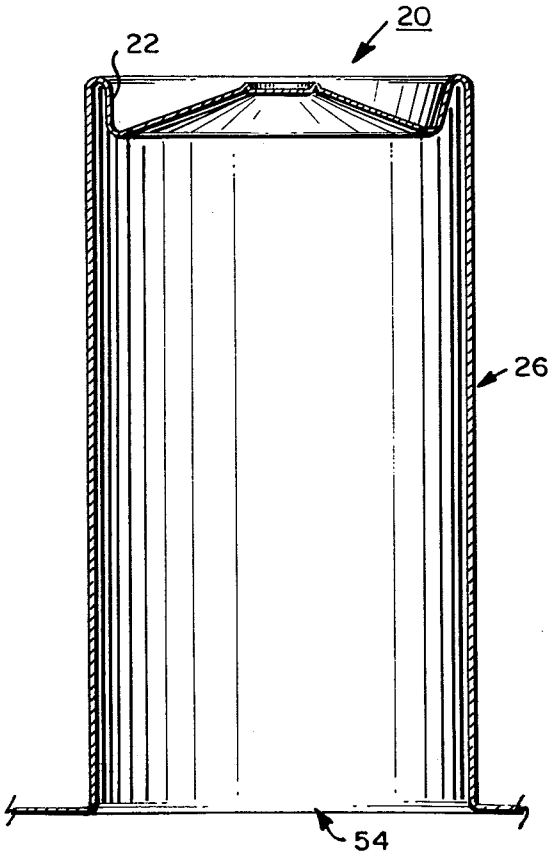
FIG. 6 is a cross-sectional side view of a beverage container incorporating an alternate embodiment of the unitary lid of the present invention showing the integral fabrication of this lid with the sidewall of a beverage container.

As may best be seen in FIGS. 1 and 2, the unitary beverage container lid 20 of the present invention incorporates a downwardly and inwardly extending peripheral sidewall 22. This sidewall incorporates a peripheral rim 24 for securing the lid to a cylindrical sidewall 26 of a standard beverage container 27. However, as best seen in FIG. 6, the peripheral sidewall may be integrally formed with the cylindrical sidewall of a beverage container if the unitary lid of the present invention is formed with the cylindrical sidewall of the beverage container through use of the deep-drawn fabricating method.

The unitary beverage container lid of the present invention further incorporates a dome-shaped central portion 28 that terminates with the inner periphery of peripheral sidewall 22. This portion as well as the peripheral sidewall are preferably fabricated from metal having a thickness of from five to eight thousandths of an inch. The dome-shaped portion comprises two radially projecting upstanding abutting ribs 30 and 32 and an upstanding arcuate tapered rib 34 that extends perpendicularly from the outer terminus of the abutting ribs along a portion of peripheral sidewall 22.

The outer edge of the rib terminates with a portion of the peripheral sidewall 22 forming an arcuate line 38 therebetween. This arcuate line is scored, preferably to two or three thousandths of an inch, so as to allow the tearing of this scored region from the peripheral sidewall during the opening operation.

Similarly, a radial line 39 defining the region where abutting ribs 30 and 32 adjoin is scored. This score line has a linear extension 39a from the outward region where the abutting two ribs terminate with the arcuate rib out to a point 40 where the outer periphery of the arcuate rib adjoins the peripheral sidewall. Thus, at point 40, the arcuate score line 38 and the radial score line 39 meet.

Furthermore, the dome-shaped central portion 28 incorporates a centrally located button 42 providing a region in which to apply manual pressure to the lid. In addition, a generally U-shaped rib 44 extends from a peripheral portion of the button outward toward the peripheral sidewall of the present invention. This rib provides structural rigidity to the lid, especially during the opening operation.

Figure 3:
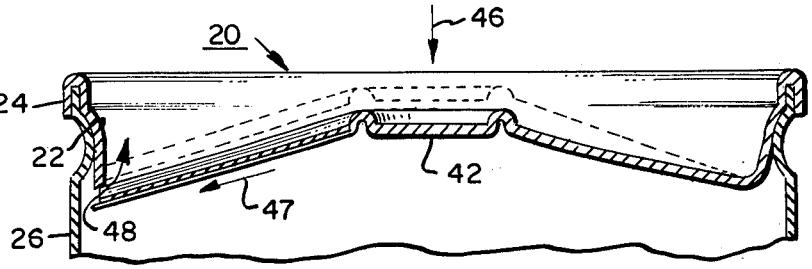
FIG. 3 is a similar cross-sectional side view of the unitary lid as shown in FIG. 2, showing the deformation of the lid during opening thereof.

The opening operation of the unitary beverage container lid 20 is best seen in FIGS. 2, 3, 4 and 5. As shown in FIG. 2 by arrow 46, manual force is exerted downward on button 42. This manual force has a vector component shown by arrow 47 extending along radial score line 39 that initially causes point 40 where score lines 38 and 39 meet to rupture. This rupturing thereby generates a region where pressurized gases within the beverage container may escape to the outside environment. This initial rupture of the junction of the two score lines is best seen in FIG. 3 with arrow 48 indicating the direction of escape of the pressurized gases within the beverage container to the outside world.

Figure 4:
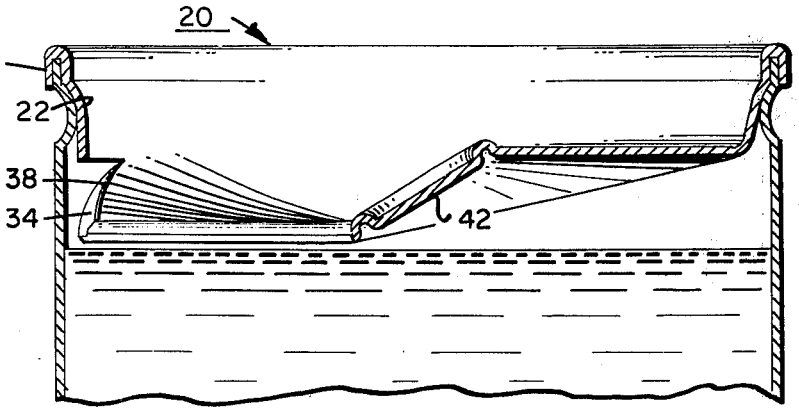
FIG. 4 is a similar cross-sectional side view of the unitary lid as shown in FIG. 2 showing the lid in the open configuration.

As also best seen in FIG. 3, the manual depression of button 42 causes the dome-shaped central portion to deform from its initial configuration. This deformation causes arcuate rib 34 to extend beneath the corresponding region in peripheral sidewall 22, which thus allows the planar radius of central portion 28 to increase. Since the planar radius of the dome portion increases while its area remains constant, an open region is necessarily generated. It is this area that defines a drinking orifice 50 (see FIG. 5). It is thus this initial deformation that causes further tearing along score line 38 which in turn allows score line 39 to open radially inward. Therefore, as best seen in FIG. 4, continued depression of button 42 causes further tearing of tapered rib 34 from peripheral rim 22 along arcuate score line 38.

Figure 5:
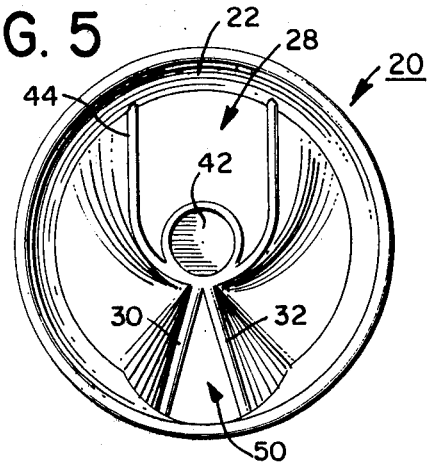
FIG. 5 is a top plan view of the unitary lid of FIG. 1 showing the lid in the open configuration.

As the arcuate rib tears from the peripheral rim, the radial score line 39 defining the interface between abutting ribs 30 and 32 continues to tear apart starting at point 40 and continuing inwardly toward central button 42. As best seen in FIG. 5, when the lid is in the configuration shown in FIG. 4, a pie-shaped drinking orifice 50 is created between abutting ribs 30 and 32. This drinking orifice is ideal for drinking therefrom dur to its shape allowing the inflow of air at the apex of the pie-shaped orifice as well as the flow of beverage from the outer portion of this orifice.

Moreover, due to the smooth edges defined by the upstanding, inverted U-shaped abutting ribs 30 and 32, the drinking orifice 50 is very safe to drink from. There are no sharp edges to cause physical injury. It will thus be seen that the drinking orifice generated by the present invention is similar in shape to the orifice generated by present-day pull-tab lids but that the orifice of the present invention has smoother edges than the pull-tab lid while generating no removable parts. Thus, the present invention eliminates two significant problems with pull-tab lids.

It should also be noticed that the length of abutting ribs 30 and 32 that define drinking orifice 50 may be of different lengths than that shown in the preferred embodiment of this invention. Thus, by making these radial ribs somewhat shorter in length, a somewhat smaller drinking orifice 50 could be generated. Furthermore, if more than one pair of abutting ribs are scored on central portion 28, two or more drinking orifices may be generated during depression of the lid from its normally dome-shaped configuration to the general concave configuration. When generating two or more drinking orifices, a first plurality of such orifices could define a drinking region while a second plurality could define a region for the inflow of air into the container during removel of the beverage from the container.

Figure 8:
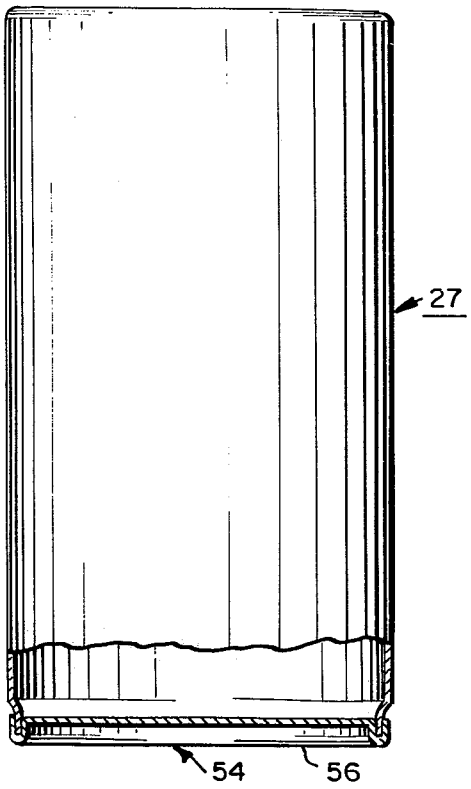
FIG. 8 is a similar partially cut away side view of the beverage container shown in FIG. 7 showing the end cap mounted to the beverage container.
Figure 7:
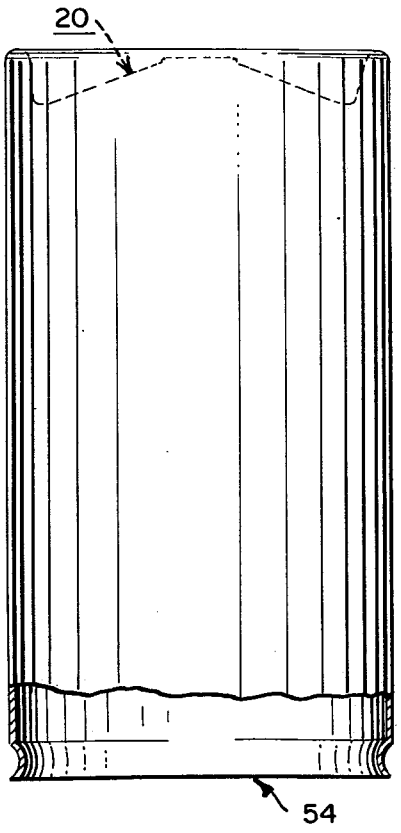
FIG. 7 is a partially cut away side view of a beverage container of FIG. 6 showing the crimping of the open end of the beverage container for receipt of a sealing end cap.

As best seen in FIGS. 6, 7, and 8, a beverage container 27 can be fabricated with an integral unitary beverage container lid 20 of the present invention. In order to fabricate such a beverage container, it is necessary that the unitary lid 20 be formed along with the cylindrical sidwall of container 26 in a deep-drawn fabricating process. At the present time, such deep-drawn beverage containers are generally manufactured from aluminum. This aluminum preferably has a thickness of from five to eight thousandths of an inch while the score lines 38 and 39 of the unitary lid 20 have a thickness of from two to three thousandths of an inch.

As best seen in FIG. 6, the first step in the process of manufacturing such a beverage container is the deep-drawing of a piece of aluminum sheet to the shape shown in FIG. 6 with the unitary container lid 20 forming an integral end cover at one end of the cylindrical sidewall 26. As shown in FIGS. 7 and 8, the remaining end 54 is then crimped in order to allow an end cap 56 to be sealed thereto. The desired beverage is then placed within the open container. Thus, as best seen in FIG. 8, the end cap 56 is sealed to the open end of sidewall 26.

In this manner, a completely sealed and pressurized beverage container 27 is generated with a unitary beverage lid 20 integrally formed at one end thereof. This fabrication technique is thus highly desirable due to the economies inherent in such a simple fabrication method.

Thus, what has been described is a unitary beverage container lid for the efficient storing of beverages whether pressurized or non-pressurized. The unitary beverage container lid is easily opened with manual pressure forming a drinking orifice that is easy and safe to drink from. Furthermore, the unitary beverage container lid of the present invention generates no removable parts after it is open. In addition, the unitary lid may be integrally formed in the fabrication of the beverage container and thus can greatly minimize the cost in fabricating such beverage containers. Although the lid is preferably fabricated from metal, such as aluminum, it should also be noted that it may be fabricated from other materials such as plastic. Such lids could be used with similarly fabricated beverage containers for storing beverages of a non-pressurized nature.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described in invention, what is claimed is:

1. A unitary lid for a container having an open end, circular in cross-section, comprising:

A. a peripheral sidewall terminating with and extending downwardly and inwardly from the open end of said container;

B. a dome-shaped central portion, depressable from a first closed position to a second open position, terminating at its periphery with the peripheral sidewall, said portion incorporating:

1. at least one radially extending score line terminating at one end with said peripheral sidewall; and

2. at least one arcuate score line extending along a portion of the periphery of the central portion and substantially bisected by at least one radially extending score line;

whereby the lid closes the container when the dome-shaped portion is in the closed position and opens the container when said portion is depressed into said open position, thereby tearing the central portion along said score lines and thereby generating a pie-shaped orifice in the region of each radially extending score line.

2. A unitary lid as defined in claim 1, wherein the central portion further comprising a pair of upstanding abutting ribs along each of said radially extending score lines whereby the edges of the pie-shaped orifices generated when said central portion is depressed into said open position have smooth edges for safe drinking therefrom.

3. A unitary lid as defined in claim 1, wherein the dome-shaped central portion further comprises at least one upstanding arcuate rib adjacent to and terminating with one of said arcuate score lines and bisected by the corresponding radially extending score line.

4. A unitary lid as defined in claim 3, wherein said arcuate rib further comprises two tapered ends.

5. A unitary lid as defined in claim 1, wherein said central portion further comprises a centrally located button to facilitate manual depression of said central portion into said open position.

6. A unitary lid as defined in claim 1, wherein said central portion further comprises a rib having a generally U-shaped extending approximately from the center of said central portion and terminating with said peripheral sidewall.

7. A unitary lid for a beverage container having an open end, circular in cross-section, comprising:

A. a peripheral rim mounted to said open end;

B. an annular sidewall extending downwardly and inwardly from said peripheral rim; and C. a dome-shaped central portion, depressable from a first closed position to a second open position, terminating at its periphery with the annular sidewall, said portion incorporating:

1. at least one radially extending score line terminating at one end with said annular sidewall; and

2. at least one arcuate score line extending along a portion of the periphery of the central portion and substantially bisected by a least one radially extending score line;

whereby the lid closes the container when the dome-shaped central portion is in the closed position and opens the container when said portion is depressed into a generally concave open position, thereby tearing the central portion along said score lines and thereby generating a pie-shaped orifice in the region of each radially extending score line.

8. A unitary lid as defined in claim 7, wherein said central portion further comprises upstanding ribs extending along and adjacent to each side of at least one of said radially extending score lines.

9. A unitary lid as defined in claim 8, wherein said central portion further comprises at least one upstanding rib extending along and adjacent to at least one arcuate score line.

10. A unitary lid as defined in claim 8, wherein said central portion further comprises a centrally located button to facilitate manual depression of said central portion into said open position.

11. A unitary lid as defined in claim 10, wherein said central portion further comprises a rib having a generally U-shape extending from said central button outwardly toward said annular sidewall.

12. A unitary lid for a beverage container having a cylindrical sidewall, comprising:

A. a peripheral sidewall terminating with and extending downwardly and inwardly from a first end of the cylindrical sidewall;

B. a dome-shaped central portion, depressable from a first closed position to a second open position, terminating with the peripheral sidewall, said portion incorporating:

1. A centrally located button to facilitate manual depression of the central portion into said open position;

2. a radially extending score line terminating at one end with said button and at a second end with said peripheral sidewall;

3. U-shaped upstanding ribs radially extending along and adjacent to each side of said score line for providing a smooth edge on each side of the radially extending score line when the central portion is depressed into said open position;

4. an arcuate score line extending along a portion of the periphery of the central portion and substantially bisected by the radially extending score line; and

5. an upstanding arcuate rib adjacent to the arcuate score line and bisected by the radially extending score line;

whereby the lid closes the container when the dome-shaped portion is in the closed position and opens the container when said portion is depressed into the open position thereby tearing the central portion along said arcuate and radial score lines and thereby generating a pie-shaped orifice in the region of the radially extending score line.

13. A unitary lid as defined in claim 12, wherein said central portion further comprises a generally U-shaped rib extending from said central button outwardly toward and terminating with said peripheral sidewall.

14. A unitary lid as defined in claim 12, wherein said lid is integrally formed with said cylindrical sidewall of the beverage container.

15. A lid comprising:

A. a peripheral rim having an outer depending sidewall;

B. an annular sidewall extending downwardly and inwardly from said peripheral rim; and C. a dome-shaped central portion, depressable from a first closed position to a second, generally concave, open position, terminating at its periphery with the annular sidewall, said portion incorporating:

1. at least one radially extending score line terminating at one end with said annular sidewall; and

2. at least one arcuate score line extending along a portion of the periphery of the central portion and substantially bisected by at least one radially extending score line;

whereby the lid is closed when the dome-shaped portion is in the first position, and is opened when said portion is depressed into a generally concave configuration, thereby tearing the central portion along said score lines and thereby generating a pie-shaped orifice in the region of each radially extending score line.

* * * * *

UNITED STATES PATENT AND TRADEMARK OFFICE

CERTIFICATE OF CORRECTION

PATENT NO. : 3,935,961

DATED : February 3, 1976

INVENTOR(S) : Robert A. Bennett

It is certified that error appears in the above-identified patent and that said Letters Patent are hereby corrected as shown below:

In the Title, please add --Lid-- after "Container"

Column 5, line 20, cancel "dur" and substitute therefor --due-- (our error)

Column 5, line 49, cancel "removel" and substitute therefor --removal--

Column 5, line 56, cancel "sidwall" and substitute therefor --sidewall--

Column 7, line 17, cancel "U-shaped" and substitute therefor --U-shape--

Column 8, line 8, cancel "A" and substitute therefor --a--

Signed and Sealed this

Sixth Day of July 1976

[SEAL]

*Attest:*

RUTH C. MASON
*Attesting Officer*

C. MARSHALL DANN
*Commissioner of Patents and Trademarks*